United States Patent [19]

Lippert

[11] 3,994,529

[45] Nov. 30, 1976

[54] STADIUM SEAT

[76] Inventor: Albert H. Lippert, 626 N. Keystone, Burbank, Calif. 91506

[22] Filed: Oct. 22, 1975

[21] Appl. No.: 624,914

[52] U.S. Cl. ..... 297/252; 297/134

[51] Int. Cl.[2] ..... A47C 1/08

[58] Field of Search ..... 297/134, 252

[56] References Cited

UNITED STATES PATENTS 2,220,865 11/1950 Hines ..... 297/252

2,694,441 11/1954 Degenfelder ..... 297/252 X

*Primary Examiner*—James C. Mitchell

*Attorney, Agent, or Firm*—William W. Haefliger

[57] ABSTRACT

A stadium chair assembly includes pivotable legs and at least one pivotal holder located to swing downwardly to return the chair to a stadium bench with the legs folded up under the seat.

7 Claims, 5 Drawing Figures

STADIUM SEAT

BACKGROUND OF THE INVENTION

This invention relates generally to portable seats, and more particularly concerns a seat usable in multiple modes one of which is stadium seating.

Stadium seats or benches are exceptionally uncomfortable as they are typically without backs and are narrow as well as hard. There is need for a means to alleviate this discomfort; however, no way is known, to my knowledge, to modify existing stadium seats to achieve this objective, without permanent re-construction.

SUMMARY OF THE INVENTION

It is a major object of the invention to provide a stadium chair assembly characterized as overcoming this problem. Basically, the assembly includes:

a. a chair seat and a chair back having hinged interconnection allowing the back to swing between upright extended position, and horizontal collapsed position relative to the seat, the connection providing stops to limit swinging of the back, b. the seat having opposite sides and a front stretch, and c. holder means having pivotal attachment to said front stretch to swing between upwardly collapsed position extending beneath said front stretch, and downwardly extended position, the holder means including arm means spaced sufficiently below said front stretch in said downwardly extended position as to project closely beneath a stadium seat for retaining the chair assembly thereto.

As will appear, the assembly typically may include torsion spring means operatively connected between the front stretch and the holder means, and yieldably urging the latter toward upwardly collapsed position; the holder means may advantageously comprise two U-shaped holder rods having rearwardly projecting portions received through openings in the front stretch which is tubular; the springs may have torsion windings received within the hollow front stretch; and the chair assembly may include legs pivotally attached to the seat allowing leg swinging between downwardly projecting extended positions and horizontally extended collapsed position adjacent the underside of the seat; the attachment may provide stops to limit swing of the legs about their pivots; the front leg supports may be greater in height than the back leg supports to incline the seat rearwardly and downwardly; and the holder arms in downwardly extended positions typically are spaced a predetermined distance below the legs in upwardly collapsed position, that distance being about equal to the thickness of a stadium bench, as will appear.

Accordingly, the chair assembly has utility not only as a stadium chair but also as a beach or lounge chair; further, the chair assembly is characterized by simplicity, portability and collapsibility, light weight construction, ease of set up and collapse in each of its utility modes; adaptation to different size stadium seats or benches, and high strength.

These and other objects and advantages of the invention, as well as the details of an illustrative embodiment, will be more fully understood from the following description and drawings, in which:

DRAWING DESCRIPTION

DETAILED DESCRIPTION

Figure 1:
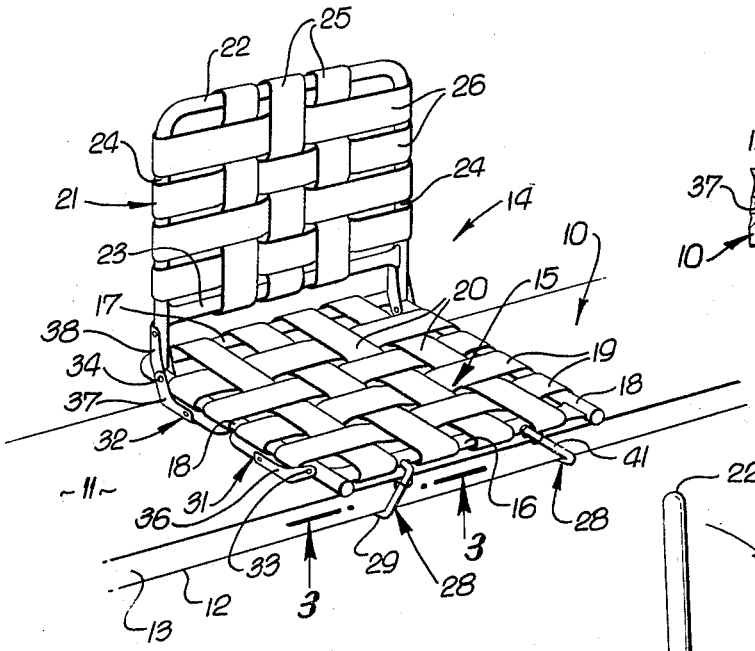
FIG. 1 is a perspective showing of the chair, in one mode of use.

In the drawings, a stadium bench or seat 10 has a top side 11, and underside 12, and a front edge 13.

The stadium chair 14 inclludes a seat 15 formed by front, rear and side tubular members or stretches 16–18, and fabric strips 19 and 20 interwoven, and connected to the members, as shown. The chair also includes a back 21 formed by upper, lower and side tubular members 22–24, and fabric strips 25 and 26 interwoven and connected to the members 22–24, as shown. The fabric may consist of plastic material, and the tubular members of aluminum.

Figure 5:
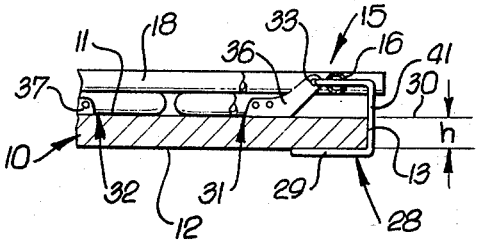
FIG. 5 is a fragmentary side elevation, taken in section, to show attachment to a stadium seat.

In accordance with the invention, holder means is provided, as for example holder rods 28, to have pivotal attachment to the front member as stretch 16, so as to swing between upwardly collapsed position or positions extending directly beneath the front stretch or seat (as in FIGS. 2 and 3), and downwardly extended position or positions (see FIGS. 1 and 5). The holder means typically includes arm means, as defined by rearwardly projecting rod first portions 29, spaced sufficiently below the front stretch 16 in downwardly extended position as to project closely beneath the stadium seat or bench 10 for retaining the chair assembly to the latter. For example, note the vertical distance *h* in FIG. 5 which is about equal to the bench top to bottom thickness. Distance *h* is defined as the distance between rod portions and a horizontal plane 30. Plane 30 is defined by the horizontal undersides of legs 31 and 32 pivotally attached to the chair as at 33 and 34, and collapsed against the underside of the seat.

Figure 2:
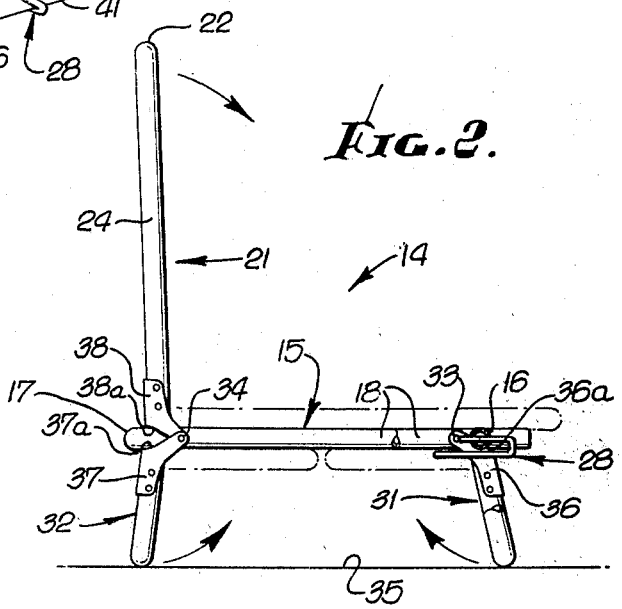
FIG. 2 is a side elevation of the chair in another use mode.
Figure 3:
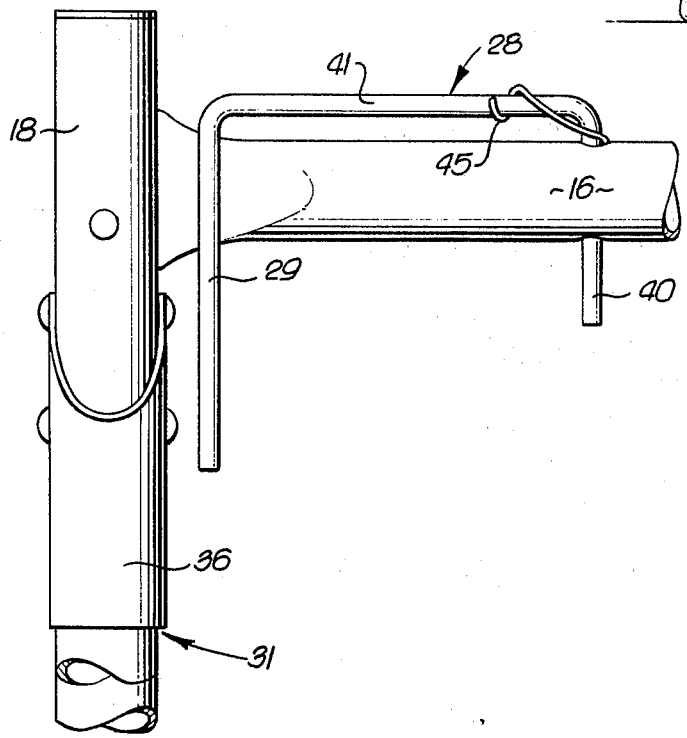
FIG. 3 is an enlarged fragmentary bottom plan view.

Note that the legs may swing between downwardly projecting extended positions (see FIG. 2 in which the legs support the chair on a surface 35, as for example a beach), and horizontally extending collapsed positions adjacent the underside of the seat (see FIGS. 1 and 5). In FIG. 2, the holder rods are collapsed against the underside of the seat, the brackets 36 and 37 integral with the legs have stop-shoulder engagement with the tubular members 18 at **36*a* and 37*a*, and the brackets 38 integral with the seat back members 24 have stop-shoulder engagement with the seat members 18 at 38*a***.

In accordance with a further aspect of the invention, torsion spring means is operatively connected between the front stretch 16 and the holders 28 so as to yieldably urge the holder means toward upwardly collapsed position, as seen in FIG. 2. Accordingly, in FIGS. 2 and 3 mode, the holder rods are kept out of the way, adjacent the underside of the seat 15; whereas, in FIGS. 1 and 5 mode, the holder rod portion 29 is constantly urged against the bottom 12 of the bench 11, so as to firmly retain the chair attached to the bench.

Figure 4:
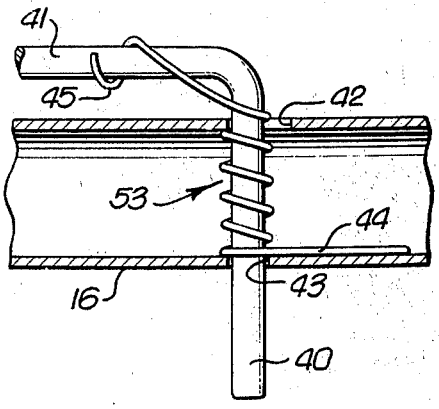
FIG. 4 is an enlarged fragmentary sectional view showing the torsional spring biasing a holder.

The holder rods are preferably U-shaped, and each includes a rearwardly projecting rod second portion 40 as well as the rearwardly projecting rod first portion 29. Rod portions 29 and 40 are interconnected by lateral rod stretch 41 extending frontwardly of tubular stretch 16, so that portion 29 remains below stretch 16 whereas portion 40 is received through openings 42 and 43 in that stretch, as is clear from FIGS. 3 and 4. Each torsion spring 53 includes opposite terminals 44 and 45. One terminal, as at 44, bears against the stretch 16 interiorly thereof, and the other terminal, as at 45, is attached to or looped about the rod stretch 41, exteriorly of the tubular stretch 16. In this regard, opening 42 may be enlarged relative to the rod diameter, and receive insertion of the torsion spring 43, upon assembly.

It should be noted that the leg and holder means have mutually non-overlapping swing paths, so as not to jam when swung between their alternate positions. Also, the holder rod portions 40 are located closer together than portions 29, so that the latter may have as widely separated a grip as possible on the bench, for lateral stability. This is clear from FIGS. 1 and 3. The holder means also accommodates to different bench thicknesses due to the overall design.

I claim:

1. In a stadium chair assembly, a. a chair seat and a chair back having hinged interconnection allowing the back to swing between upright extended position, and horizontal collapsed position relative to the seat, there being stops to limit swinging of the back, b. the seat having opposite sides and a sidewardly elongated front stretch, c. U-shaped holder means having pivotal attachment to said front stretch to swing between upwardly collapsed position extending beneath said front stretch, and downwardly extended position, the holder means including arm means spaced sufficiently below said front stretch in said downwardly extended position as to project closely beneath a stadium seat for retaining the chair assembly thereto, d. torsion spring means operately connected between said front stretch and said holder means, and yieldably urging the holder means toward said upwardly collapsed position, said front stretch being tubular and said torsion spring means having torsion windings received within said tubular stretch and two terminals, one terminal confined within the stretch against rotation and the other terminal attached to the arm means exteriorly of said stretch, e. and legs pivotally attached to said chair seat allowing leg swinging between downwardly projecting extended positions and horizontally extending collapsed positions adjacent the underside of the seat, there being stop shoulders to limit said swinging, the legs and holder means having mutually non-overlapping swing paths.

2. The chair assembly of claim 1 wherein said holder means comprises two U-shaped holder rods, said arm means defined by rearwardly projecting rod first portions, the holder rods also including rearwardly projecting rod second portions received through openings in said front stretch.

3. The chair assembly of claim 2 wherein said torsion spring means comprises two torsion springs respectively associated with said two rods, each spring having torsion windings received within said tubular front stretch.

4. The chair assembly of claim 3 wherein each torsion spring includes opposite terminals, one terminal bearing against said front stretch interiorly thereof, and the other terminal attached to a rod stretch which extends parallel to said tubular stretch.

5. The chair assembly of claim 1 wherein the legs are attached to seat side stretches.

6. The chair assembly of claim 1 wherein the seat and back have tubular frame construction.

7. The assembly of claim 4 wherein the undersides of the legs in collapsed position define a horizontal plane, and the rod arms in downwardly extended positions project beneath said plane at a vertical distance therefrom about equal to the thickness of a stadium bench.

* * * * *